United States Patent [19]

Pearl, II et al.

[11] Patent Number: 4,661,057

[45] Date of Patent: Apr. 28, 1987

[54] COMBUSTION DEVICE

[75] Inventors: David S. Pearl, II, Fort Lauderdale; Louis H. Webb, III, Dania; Stephen B. Kocell, Pompano Beach, all of Fla.

[73] Assignee: Uniweld Products Incorporated, Ft. Lauderdale, Fla.

[21] Appl. No.: 719,995

[22] Filed: Apr. 4, 1985

[51] Int. Cl.[4] ..... F23D 11/44

[52] U.S. Cl. ..... 431/243; 431/240; 431/354; 165/185

[58] Field of Search ..... 431/11, 206, 207, 240, 431/243, 344, 354, 355, 350; 165/185

[56] References Cited

U.S. PATENT DOCUMENTS

| | | | |
|---|---|---|---|
| 629,300 | 7/1899 | Merkel . | |
| 898,864 | 9/1908 | Futterman | 239/135 |
| 1,042,930 | 10/1912 | Lanfredi | 431/207 |
| 1,466,186 | 8/1923 | Pidgeon | 431/243 |
| 1,510,024 | 9/1924 | Warner . | |
| 2,571,629 | 10/1951 | Strom | 431/207 |

FOREIGN PATENT DOCUMENTS

| | | | |
|---|---|---|---|
| 141343 | 11/1934 | Austria . | |
| 104004 | 9/1898 | Fed. Rep. of Germany . | |
| 191717 | 12/1906 | Fed. Rep. of Germany | 431/207 |
| 611755 | 12/1930 | Fed. Rep. of Germany . | |
| 344531 | 11/1904 | France . | |
| 350240 | 11/1905 | France . | |
| 26324 | of 1897 | United Kingdom | 431/243 |
| 404996 | 4/1974 | U.S.S.R. . | |

*Primary Examiner*—Margaret A. Focarino
*Attorney, Agent, or Firm*—Sandler & Greenblum

[57] ABSTRACT

A fuel gas combustor which utilizes thermal assisted expansion and mixing of the fuel gas and a combustion supporting gas for more complete combustion and greater heat output. A heat transfer device provides thermal feedback from the flame to the gas expansion zone. The invention is especially useful in hand-held torch tips. In a specific embodiment, the heat transfer device include a heat conducting element, at least the intermediate portion of which is rod shaped and sheathed in a non-conducting envelope.

10 Claims, 10 Drawing Figures

FIG. 5.
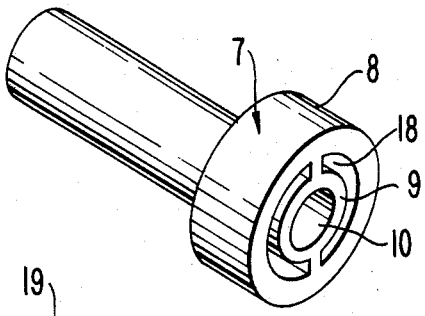
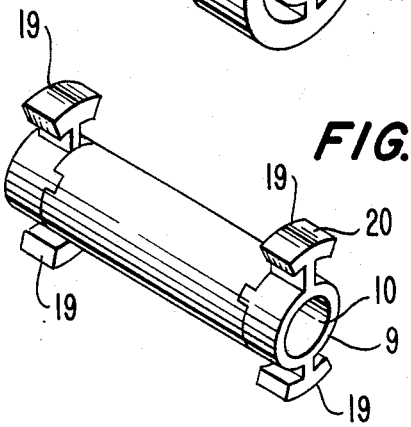
FIG. 6.
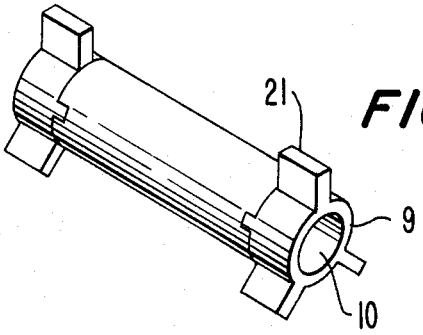
FIG. 7.
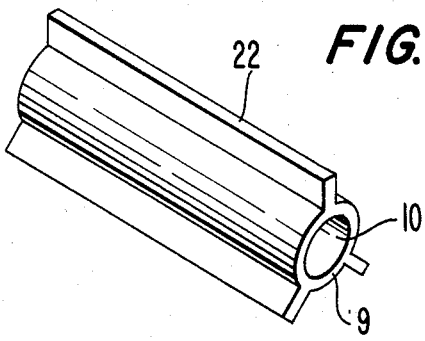
FIG. 8.

COMBUSTION DEVICE

BACKGROUND OF THE INVENTION

This invention relates to a fuel combustor, more particularly to a torch tip, and specifically to a hand held torch tip.

U.S. Pat. No. 4,013,395 to Alex F. WORMSER describes a torch disclosed as capable of supplying much higher velocity gases than conventional torches, resulting in higher heating effectiveness than prior torches using the same fuel and oxidizer. This torch utilizes a vortex generator for supplying swirling gases to the combustion chamber.

It is an object of the present invention to provide a torch tip capable of outperforming one utilizing a vortex generator, as in U.S. Pat. No. 4,013,395, without the necessity of swirling the gases and which utilizes only the energy in the fuel gas and the heat of the flame.

It is a further object of the invention to provide such a torch tip which will work at any pressure range. It is a still further object of the invention to utilize the heat of the flame to assist the expansion and mixing of the fuel gas and oxidizing gas so as to effect more complete combustion and greater heat output.

It is a still further object of the invention to provide enhancement means wherever a flame is employed, as in stove burners, furnace burners, heaters and torches, i.e., in combustion devices generally.

SUMMARY OF THE INVENTION

These and other objects of the invention are attained by providing a combustion device adapted to receive a combustible gas and a combustion supporting gas, which includes a zone for expanding and mixing these gases, passageways for conveying the gases from such zone to a flame zone, and means for conducting heat from the flame zone to the expanding and mixing zone. In one aspect of the invention, the heat is conducted from inside the flame zone. In another aspect, an intermediate portion of the heat conducting means is insulated to prevent the dissipation of heat. Preferably, the heat conducting means is a metallic element such as a rod and is sheathed in an insulating envelope, both rod and envelope preferably being cylindrical. Most suitably the rod and sheath are axially positioned in a tubular section of the combustion device connecting the flame zone with the expanding and mixing zone. Passageways for the gases are provided either in the insulating envelope structure or by the cooperation of the insulating envelope with the tubular section.

In another aspect of the invention, a metal rod, insulated as above described, is positioned to conduct heat from the flame zone, but not necessarily from inside the flame zone. For example, the rod may be positioned to conduct heat from a zone surrounding or adjacent to the flame zone.

More specifically, the invention provides a torch tip comprising (a) a tubular metal sleeve having a larger diameter forward section, a smaller diameter rearward section and a frustoconical transition section connecting said forward and rearward sections, the rearward section being adapted to receive fuel gas and combustion supporting gas such as air; (b) a non-heat conducting cylindrical sleeve coaxially disposed in the forward portion, the outer cylindrical surface of such sleeve being in contact with the inner surface of the metal sleeve, the forward portions of the two sleeves being coterminous; (c) a heat retainer axially disposed in the forward portion of the metal sleeve, preferably having its forward end surface abutting the rearward end surface of the non-conducting sleeve and its rearward and coterminous with the rearward end of the forward section of the metal sleeve, such heat retainer having an axial cylindrical hub having an axial cylindrical passageway extending its entire length, and being provided with means for maintaining it in the specified relationship and means defining longitudinal passageways outwardly of the axial passageway and extending the length of the heat retainer; (d) heat transfer means having a cylindrical portion and a conical portion, the cylindrical portion being axially disposed within the cylindrical passageway of the heat retainer and extending forwardly therefrom into the tubular metal sleeve, but not to its mouth, the base of the conical portion abutting the rearward end surface of the cylindrical portion, whose outer surface is in contact with the surface of the passageway.

The torch tip may suitably be provided with air intake means and adapted to cooperate with fuel introduction means.

Another aspect of the invention is in a heat transfer device which includes a heat conducting element, at least the intermediate portion of which is rod shaped, and a non-heat conducting envelope or sheath for that portion. The intermediate portion and one end portion of the heat transfer element are suitably cylindrical and the other end conical, the base of the conical portion abutting the intermediate portion and preferably being of larger diameter than the intermediate portion.

The non-heat conducting sheath is suitably provided with a cylindrical hub portion having an axial passageway extending its entire length and means for maintaining it in coaxial relationship with an outer sleeve. Such means may be of varying configurations, including fins helical to the hub portion.

BRIEF DESCRIPTION OF THE DRAWINGS

The invention is illustrated by the appended drawings, in which:

FIG. 1 is an isometric view of the torch tip of this invention, cut away to show the internal arrangement;

FIG. 2 is an enlarged cross-sectional view of a forward section of the torch tip showing the heat retainer and heat transfer device of this invention, taken at the plane 2—2;

FIG. 3 is an enlarged cross sectional view of a more forward section of the torch top showing the heat retaining sleeve, taken at the plane 3—3.

FIGS. 4–9 are isometric views of alternative heat retainer configurations.

DESCRIPTION OF SPECIFIC EMBODIMENTS

Figures 1, 2, 3, 4:
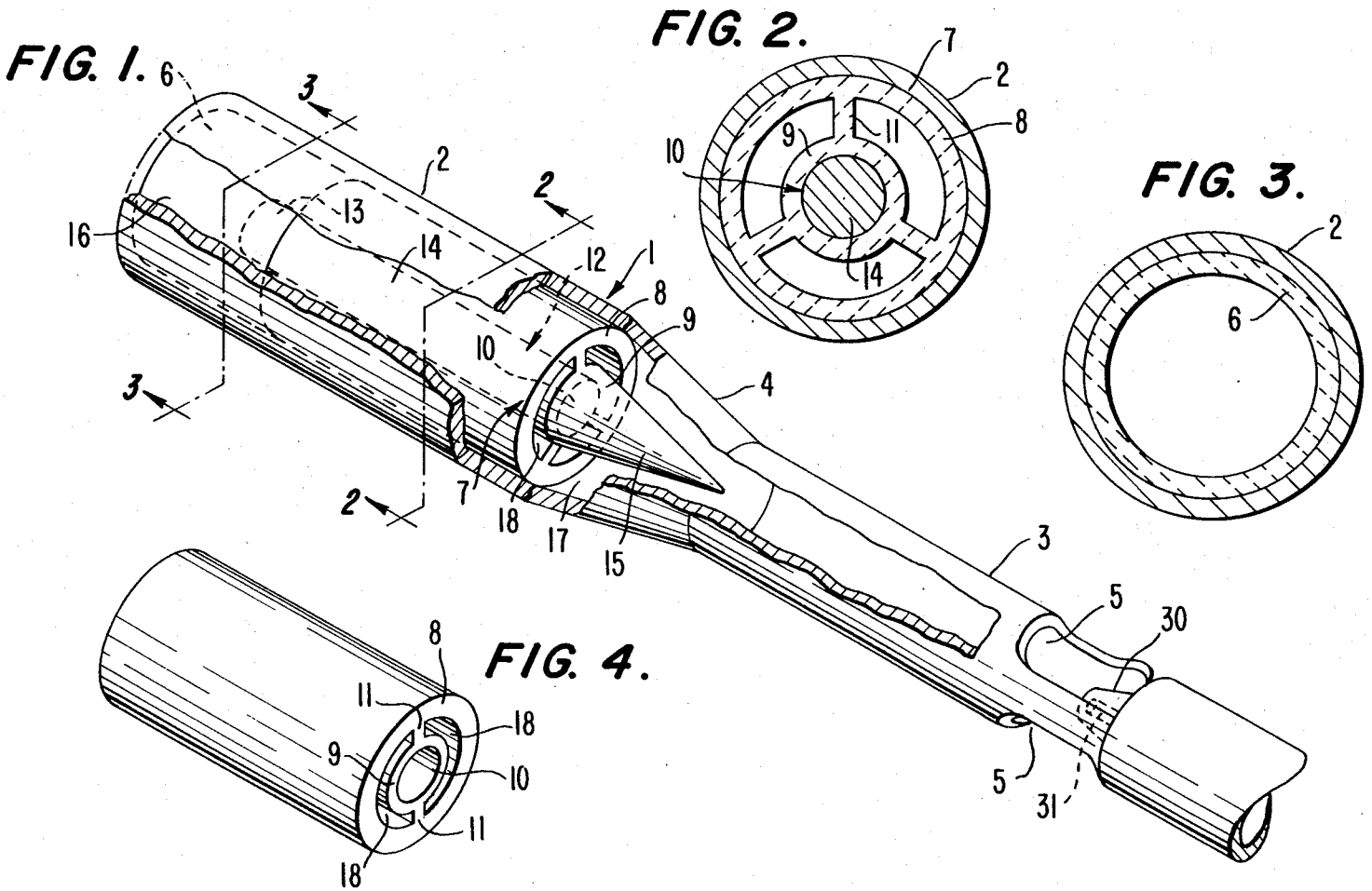

Referring to FIG. 1, there is shown a torch tip having a generally tubular metal sleeve designated generally as 1, which consists of a larger diameter cylindrical forward section 2, a smaller diameter cylindrical rearward section 3, and a frustoconical transition section 4 connecting the cylindrical sections. The forward and rearward sections 2 and 3 are shown here as straight sections in axial alignment, but other configurations may be employed. For example, the rearward section 3 may be curved. The rearward end portion of the rearward section 3 is shown provided with means for introducing gaseous fuel and ambient air. These means comprise orifices 5 (shown here as three symetrically arranged openings) for admitting ambient air and an inlet conduit for fuel gas terminating in a frustoconical nozzle 30 provided with a passageway 31 opening into that portion of the rearward end 3 of the torch tip 1 which is provided with the orifices 5. Alternatively, instead of being provided with the orifices 5 and nozzle 30, other means of introducing fuel gas into the rearward section 3 of the torch tip 1 may be employed. For example, such rearward section 3 may be adapted to be secured to means for introducing fuel and combustion supporting gas. Axially disposed within the forward portion of the forward section 2 of the metal sleeve 1 and in contact therewith is an insulating, preferably ceramic, cylindrical sleeve 6, also shown in FIG. 3, the forward portions of the sleves 1 and 6 being coterminous. The ceramic sleeve 6 defines a flame zone 16. Also axially disposed in the forward section 2 is a heat retaining, preferably ceramic, element 7, the forward end surface of which abuts the rearward end surface of ceramic sleeve 6, and the rearward end of which is coterminous with the rearward end of the forward section 2 of the metal sleeve 1. The heat retaining element 7, as also shown in FIG. 2, has a cylindrical outer shell 8 and an axially disosed cylindrical hub 9 provided with an axial cylindrical passageway 10. The hub 9 may be supported within shell 8 by any suitable means, as by longitudinally disposed ribs or fins 11, here shown as three in number and symmetrically arranged around the hub 9. Closely fitting inside the passageway 10 is a heat transfer element 12, preferably of copper construction, which consists of a cylindrical heat absorption portion 13, a cylindrical heat transfer portion 14 and a heat conduction and radiation tip 15.

The heat absorption and heat transfer portions 13 and 14 may be of the same diameter and may be parts of a single cylindrical portion, as shown in the drawing. The heat conduction and radiation tip 15 is shown here in the shape of a right circular cone, the base of the cone being of larger diameter than and concentric with and abutting the rearward end surface of the heat retainer 7. The heat absorption portion 13 extends into the flame zone 16 and the conduction and radiation tip 15 extends into the transition section 4 and rearward section 3 of the sleeve 2. The exact shape of the conduction and radiation tip 15 is not critical, so long as the portion extending into transition section 4 has sufficient surface area to transfer heat adequately to the gases passing through expansion and mixing zone 17. The conical shape is advantageous in that it maximizes the gas flow velocity. Other shapes would be mandated by the desired flame characteristics and the physical shapes and sizes of the gas passageways. The space between tip 15 and the inner walls of the sleeve 2 constitutes an initial expansion and mixing zone 17. the spaces 18 between the shell 8 and the hub 9 of the heat retainer 7 constitute passageways for the passage and further expansion of gas.

In operation, fuel gas and ambient air are introduced into the rearward end of the rearward section 3 and flow toward the conduction and radiation tip 15 of the heat transfer element 12. During combustion, heat transfer element 12 transfers heat from within the flame in flame zone 16 to the tip 15. The cold gases from the nozzle hit the thus heated tip 15 and expand violently, causing a rapid inrush of ambient air and resulting in a thorough mixing of the air and fuel gas, which makes for a more complete combustion of the fuel. The heated and expanded mixed gases pass through passageways 18, where additional mixing occurs, to the forward end surface of the heat retainer 7, where they ignite, the forward end of the heat retainer thereby serving as a flameholder.

FIGS. 4 to 9 show lternative structures for the heat retainer 7. Each of these is shown provided with an identical hub portion and axial passageways as in FIGS. 1 and 2, the corresponding parts being similarly numbered. FIG. 4 shows a heat retainer similar to that shown in FIGS. 1 and 2 except that it is provided with only two symmetrically disposed ribs 11.

Figure 9:
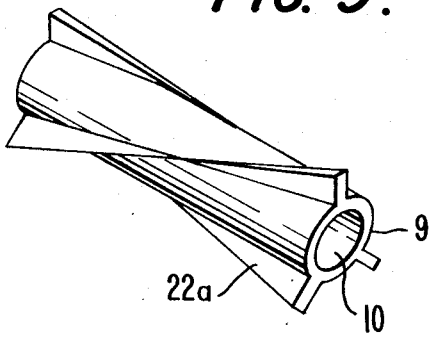

In FIG. 5, the shell portion 8 extends only part of the length of the heat retainer 7. In FIG. 6, two outwardly extending symmetrically positioned ribs 19 having arcuate outer portions 20, conforming to the inner surface of the forward section 2 of metal sleeve 1, are positioned at each end of the hub 9. FIG. 7 is similar to FIG. 6 except that the ribs, three in number and designated 21, do not have an arcuate end portion. In FIG. 8, three symmetrically positioned ribs 22 extend the length of the heat retainer 7. In FIGS. 5–9, the spaces between the heat retainer 7 and the wall of the sleeve 1 constitute passageways for the passage of gases. In FIG. 9, the ribs designated here as 22*a*, are in the form of fins helical to the surface of hub 9. The helical gas passageways provided by this embodiment, by decelerating the gases, assist in controlling the velocity of the gases within the range at which they ignite at the forward end of heat retainer 7, which functions as a flameholder.

Figure 10:
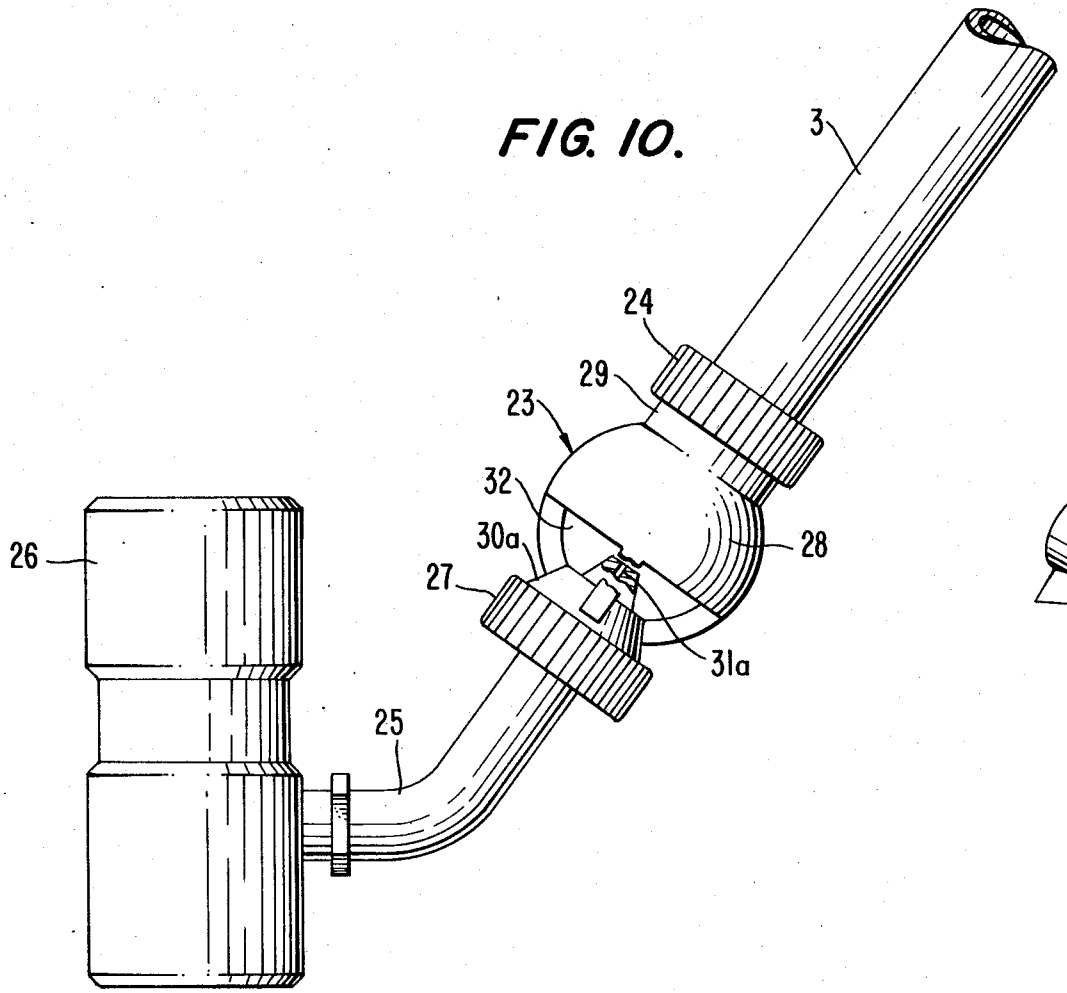
FIG. 10 is a planar view of a torch tip of this invention secured to air intake and fuel introduction means.

FIG. 10 shows how the torch tip sleeve 1 may be secured to means for introducing fuel gas and air. As shown in FIG. 8, the rearward end of the rearward portion 3 of the torch tip sleeve 1 is secured to air and fuel intake means 23 by means of a threaded coupling 24. The intake means 23 is secured to an outlet conduit 25 of a fuel gas reservoir 26 by means of a threaded coupling 27. The fuel intake means 23 consists of a partially enclosed spherical chamber 28, an outlet conduit 29 threaded for engagement with the threaded end of the rearward tip section 3 and an inlet conduit 30*a* threaded for engagement with the threaded outlet end of conduit 25, the two conduit portions of the intake means being positioned at oposite ends of chamber 28. The inlet conduit 30*a* includes a frustoconical nozzle section provided with a central passageway 31*a* which extends into the unenclosed portion 32 of the chamber 28, directly opposite the outlet conduit 29. As shown here, the unenclosed portion 32 is divided into four equal portions symmetrically arranged around nozzle section 31*a*, so that fuel injected into chamber 28 draws in and is entrained by air entering the unenclosed portion. The gas and air exit chamber 28 by means of outlet conduit 29 and enter the rearward portion 3 of the torch tip sleeve 1.

Although the combustion device of this invention may be used with any type of combustible gas, including acetylene, it is especially suitable for use with fuel gases such as propane, propylene, butane, butylene, MAPP, etc. and mixtures thereof (MAPP being a trademark of AIRCO, Inc. for methyl acetylene-propadiene), which have less B.T.U. per cubic foot than acetylene.

Although the invention has been specifically described with reference to particular means and embodiments, it is to be understood that the invention is not limited to the particulars disclosed and extends to all equivalents within the scope of the claim.

I claim:

1. A combustion device adapted to receive a combustible gas and a combustion supporting gas, comprising means defining a zone for expanding and mixing said gases, means defining a flame zone, means for conveying the gases from the expanding and mixing zone to said flame zone, and means for conducting heat from inside said flame zone to said expanding and mixing zone, said means for conducting heat being a metallic element extending from within said flame zone to said expanding and mixing zone, the portion of said metallic element intermediate said flame zone and said expanding and mixing zone being provided with insulating means to prevent the dissipation of heat.

2. A combustion device adapted to receive a combustible gas and a combustion supporting gas, comprising means defining a zone for expanding and mixing said gases, means defining a flame zone, means for conveying said gases from said expanding and mixing zone to said flame zone, means for conducting heat from said flame zone to said expanding and mixing zone, said heat conducting means being provided with an insulating sheath intermediate said flame zone and said expanding and mixing zone.

3. A combustion device of claim 2 wherein said means for conducting heat from said flame zone to said expanding and mixing zone means is a metallic element extending from within said flame zone to said expanding and mixing zone.

4. A combustion device of claim 1 wherein said insulating means is an insulating envelope.

5. A combustion device of claim 4 wherein said intermediate portion of said metallic element and said insulating envelope are cylindrical.

6. A combustion device of claim 5 having a tubular section connecting said flame zone with said expanding and mixing zone and said metallic element and said insulating envelope are axially positioned within said tubular section.

7. A combustion device of claim 6 wherein said insulating envelope is provided with passageways for said gases.

8. A combustion device of claim 6 wherein said insulating element cooperates with said tubular section to provide passageways for said gases.

9. A torch tip comprising:

(a) a tubular metal sleeve having a larger diameter forward section, a smaller diameter rearward section and a frustoconical transition section connecting said forward and rearward sections, said rearward section being adapted to receive fuel gas and combustion-supporting gas;

(b) a non-heat conducting cylindrical sleeve coaxially disposed in the forward portion of said forward section of said metal sleeve, the outer cylindrical surface of said non-heat conducting sleeve being in contact with the inner surface of said metal sleeve, and the forward portion of said non-heat conducting sleeve being coterminous with said metal sleeve;

(c) heat retainer means axially disposed in the forward section of said metal sleeve, having its forward end surface abutting the rearward end surface of said non-heat conducting sleeve, and its rearward end coterminous with the rearward end of the forward section of said metal sleeve, said heat retainer means having an axial cylindrical hub provided with an axial cylindrical passageway extending the length of said heat retainer means, means for maintaining said heat retainer means in coaxial relationship with said metal sleeve, and means defining longitudinal passageways outwardly of said axial passageway and extending the length of said non-heat conducting heat retainer means; and (d) heat transfer means having a cylindrical portion and a conical portion, said cylindrical portion being axially disposed within said cylindrical passageway of said heat retainer means and extending forwardly therefrom into said sleeve, but not to the mouth thereof, the base of said conical portion abutting the rearward end surface of said cylindrical portion, said base being of larger diameter than said cylindrical portion, the outer surface of said cylindrical portion being in contact with the surface of said axial cylindrical passageway of said heat retainer means.

10. A torch tip of claim 9 wherein said rearward section of said tubular metal sleeve is provided with air intake means and is adapted to cooperate with fuel introduction means.

* * * * *